US006332423B1

(12) United States Patent
Petersen

(10) Patent No.: US 6,332,423 B1
(45) Date of Patent: Dec. 25, 2001

(54) MARINE ANCHOR

(75) Inventor: Edward R Petersen, Kingston (CA)

(73) Assignee: Kingston Anchors Limited, Kingston (CA)

( * ) Notice: Subject to any disclaimer, the term of this patent is extended or adjusted under 35 U.S.C. 154(b) by 0 days.

(21) Appl. No.: 09/779,664

(22) Filed: Feb. 9, 2001

(51) Int. Cl.[7] ..... B63B 21/34
(52) U.S. Cl. ..... 114/301; 114/293
(58) Field of Search ..... 114/293, 301, 114/304

(56) References Cited

U.S. PATENT DOCUMENTS

| | | |
|---|---|---|
| 1,974,933 | 9/1934 | Taylor . |
| 2,507,563 | 5/1950 | Farren . |
| 4,397,256 | 8/1983 | Bruce . |
| 4,827,863 | 5/1989 | Scholz . |
| 5,138,967 | 8/1992 | McCarron . |
| 5,188,055 | 2/1993 | Kershner . |
| 5,855,181 | 1/1999 | Oxford . |
| 5,970,902 | 10/1999 | Francis . |
| 6,038,996 | 3/2000 | Giles . |
| 6,148,758 | 11/2000 | Wilkins . |
| 6,155,194 | 12/2000 | Hoareau . |

*Primary Examiner*—Jesus D. Sotelo
(74) *Attorney, Agent, or Firm*—Dowell & Dowell, P.C.

(57) ABSTRACT

A marine anchor having a shank connectible to an anchor rode at one end and having a double ploughshare fluke rigidly mounted at the other end thereof is described. The fluke consists of two symmetrically mounted part-cylindrical blades disposed on each side of a central ridge in the medial plane of the shank and extending from a forward apex to divergent trailing ends. A ballast weight is mounted under the convex surfaces of the blades and contained within the tangential plane to the convex surfaces. Each blade is also provided with a fin along the outer edge thereof, perpendicular to the central edge and located aft of the junction of the shank and the fluke.

7 Claims, 2 Drawing Sheets

MARINE ANCHOR

FIELD OF THE INVENTION

The present invention relates to marine anchors and more particularly to an improved fixed shank plow anchor.

BACKGROUND OF INVENTION

With the increased use of remotely controlled anchor windlasses for deploying and retrieving the anchor automatically, anchors require the following characteristics for successful operation: (1) the anchor must exit and enter the retaining anchor roller or davit smoothly, (2) the anchor must set quickly in all types of bottoms, and (3) the anchor must penetrate deeply into the seabed to develop high holding resistance. While numerous forms of anchors have been developed over the years for use by small vessels, both pleasure craft and work boats, all have their disadvantages and as far as is known, none completely fulfill the criteria set forth above.

U.S. Pat. No. 1,974,933 to Taylor, in 1934, discloses the first plow-type anchor and consists of an articulated shank attached to symmetrical plow shaped flukes. While this anchor holds well when set, it has difficulty setting, particularly in a hard seabed, and the hinge in the articulated shank causes difficulty in stowing and releasing the anchor in an automated system.

U.S. Pat. No. 4,397,256 to Bruce, in 1983, discloses an anchor having symmetrical flukes and a fixed connection between the shank and the flukes. Bruce specifies a shank that is of a rotated L shape that results in an anchor that is difficult to stow, retrieve and release.

U.S. Pat. No. 5,138,967 to McCarron et al. discloses a one-piece plow anchor with the shank rigidly fixed to a symmetrical double bladed ploughshare fluke. The flukes are inwardly dish shaped and may be either curved or consist of two or more flat sections with the trailing end portion of the fluke extending substantially obliquely with respect to the central ridge and so that the fluke presents a substantial surface area facing in the direction of the pull on the anchor. The concave leading edge may be either a smooth curve or comprises at least two straight lined segments. In contrast, in the present invention, the flukes are portions of a cylindrical section with the leading edge having a down and outward pointing fin lateral from the joint between the shank and the flukes.

U.S. Pat. No. 5,188,055 to Kershner discloses one- piece plow-type anchor with flukes that have a relatively broad tail portion lateral to the direction of pull on the anchor.

U.S. Pat. No. 5,855,181 to Oxford discloses a fixed shank plow anchor with flukes consisting of flat sections devoid of any downward pointed projections.

U.S. Pat. No. 6,148,758 to Wilkins discloses a plow-type anchor with flukes consisting of triangular flat sections and a pivoting mechanism in the shank.

All plow-type anchors are of the burying type. That is, the anchor when pulled will continue to bury deeper into the seabed until a solid bottom is reached. In hard bottoms this usually occurs when the flukes are buried. However, in soft bottoms the anchor will continue to move downward until even the shank is below the surface of the seabed. Good holding power in all types of bottoms depends on whether or not the anchor will bury itself deeper and deeper when a forward pull is applied.

When the anchor is lowered to the seabed, the anchor will usually be on one of its sides, resting on the forward end of the shank, the forward tip of the flukes and on the aft edge of one of the flukes. When a forward pull is applied to the anchor the tip of the flukes must penetrate the surface of the seabed to start the burying action. As the anchor is buried, the forward motion will upright the anchor. In a hard seabed, such as packed sand or clay, many plow-type anchors have difficulty penetrating the surface.

OBJECT OF THE INVENTION

An object of the present invention is to provide an improved fixed-shank plow-type anchor that overcomes the shortcomings of the prior art and includes the following interrelated factors:

(1) The anchor is of the fixed-shank plow-type with a pair of symmetrical blades forming a fluke known as a double-bladed ploughshare fluke. The shank is attached to the fluke, with no movement permitted between the fluke and the shank;

(2) Each blade of the fluke is a portion of a cylindrical section. The two blades are joined along a central ridge that is on the median plane of the anchor;

(3) The leading edge of the fluke is shaped so that the forward half of each cylindrically shaped blade will sit flat on a surface when the anchor is upright, with the central ridge sloping upward and aft from this surface;

(4) The shank is attached to the central ridge of the fluke with the forward edge of the shank approximately 75 percent of the distance along the central ridge from the forward point of the fluke;

(5) Each blade has a lateral fin that projects perpendicular to the central ridge, lies within the cylindrical shape of the blade, and extends laterally from the aft of the central ridge of the fluke; and, preferably, (6) The shank is constructed from thin, high strength, steel so as to permit a low profile in the fore and aft direction while maintaining strength when the anchor is pulled laterally. The leading edge of the shank consists of a section that extends tangentially to a circular curve that terminates at the connection between the shank and the flukes.

In the present anchor the flukes are portions of cylindrical sections with the axis of the cylindrical sections parallel to the central ridge of the flukes, which is the direction in which the anchor must move to bury itself, providing minimum resistance to the burying motion. Once set, the broad aft sections of the flukes provide the holding resistance.

In the present invention, the aft edge of each fluke has a fin that trips the anchor to start the burying action. These fins also act as stabilizers as the anchor is buried. Being well aft of the center of gravity of the anchor the fins provide additional drag on each side of the anchor preventing premature break-outs. In sea trials, anchors of the present invention have been found to set faster than any of the prior art anchors referred to above.

The curved leading edge of the shank, where it connects to the fluke, is a thin section which minimizes drag as the anchor is buried. In addition, the curved-forward edge of the shank permits the anchor to enter and leave an anchor roller smoothly, which is a highly desirable feature for modern automated anchoring systems.

BRIEF DESCRIPTION OF INVENTION

Thus, by one aspect of this invention, there is provided a marine anchor of the type that buries in the seabed when a longitudinal pull is applied, comprising a longitudinal shank having a proximal end connectible to an anchor rode, and a distal end having a double-bladed ploughshare fluke rigidly mounted thereon; and wherein:

a) said shank has a forward edge consisting of a straight section that is tangential to a curved section that terminates at the fluke;

b) said fluke comprises a pair of symmetrically mounted blades, each having partially cylindrical convex and concave surfaces, with a pointed end forward and a divergent rearward section, rigidly connected to each other along a central ridge and symmetrical about a longitudinal medial plane, and wherein the longitudinal axis of each said partial cylindrical surface lies parallel to the central ridge, and the forward edge of the fluke lies on the intersection of the cylindrical surfaces of the blades and a horizontal plane when in an upright position; and c) each said blade of the fluke includes, along an outer edge thereof, a fin in a plane perpendicular to a longitudinal plane of the central ridge, spaced laterally from the aft end of the central ridge.

DETAILED DESCRIPTION OF THE PREFERRED EMBODIMENT

Figure 1:
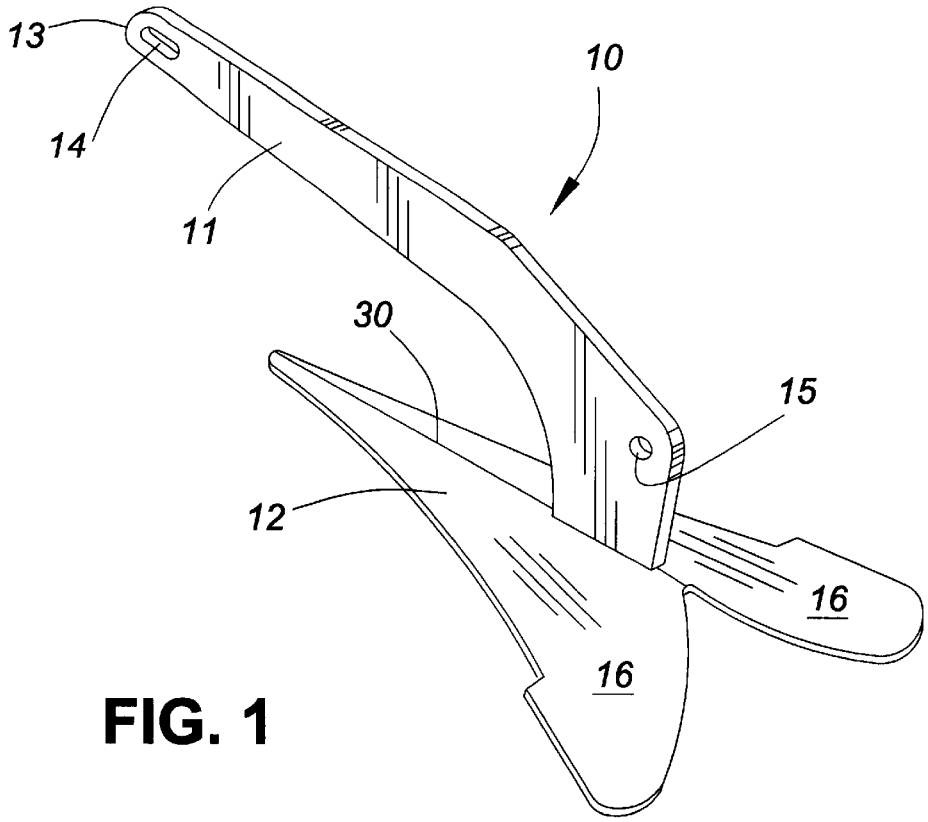
FIG. 1 is an aft side perspective view of an anchor according to one embodiment of the present

With reference to the figures, a preferred embodiment of the present invention is designated by the reference numeral 10, and is seen to include a shank 11 and a symmetrical ploughshare like fluke 12.

Figure 2:
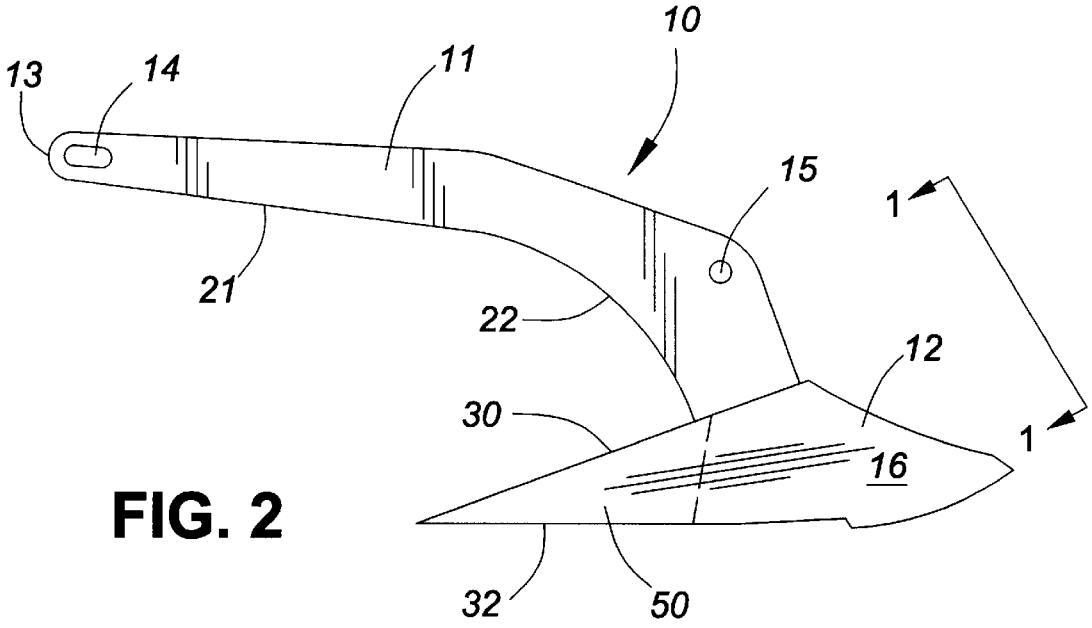
FIG. 2 is a side elevational view of the anchor shown in FIG.1.
Figure 3:
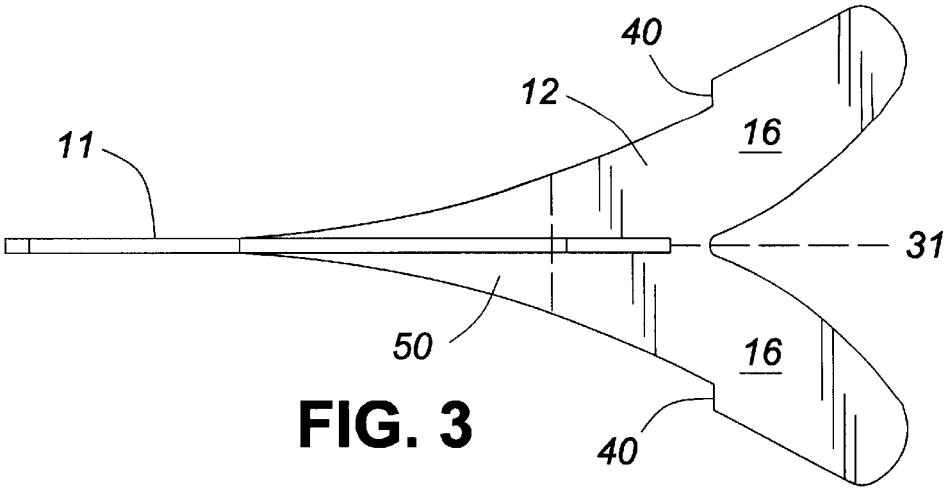
FIG. 3 atop plan view of the anchor shown in FIG. 1.
Figure 4:
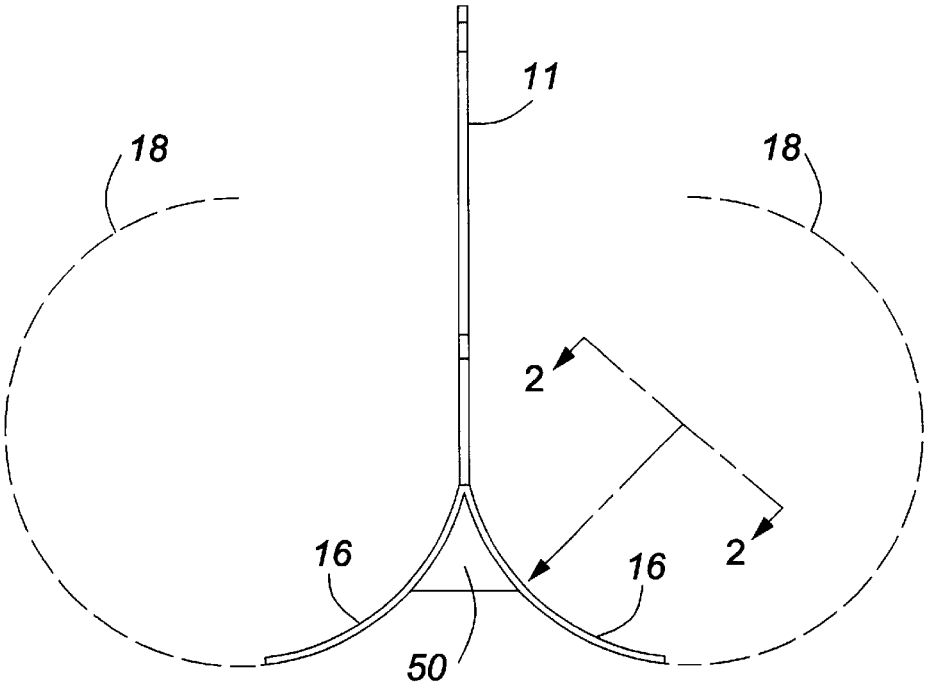
FIG. 4 ross sectional view of the anchor in FIG. 1 along the line 1—1 of FIG. 3, in the direction of the central ridge of the fluke and the axis of the cylindrical surface of each blade.

The shank 11 includes a forward end 13 having a slot 14 through which an anchor rode or chain (not shown) is attached to the vessel deploying the anchor 10. As best seen in FIG. 2, the shank 11 consists of a straight section 21 that extends from the forward end 13 and is tangential to a curved section 22 that terminates at the junction 23 between the shank 11 and the fluke 12, which junction is usually at about the midpoint of the fluke. Directly above the junction 23 is a hole 15 used to attach a pennant, a trip line or for securing the anchor 10 when stowed. As seen in FIG. 3 and FIG. 4, the shank 11 is a thin section made of high strength steel. In a preferred embodiment the length of the shank is about 1.5 times the length of the fluke.

The fluke 12 consists of two symmetrical blades 16 joined along the central ridge 30 that is on the centerline 31 of the anchor 10, the blades being mirror images about the centerline 31 as shown in FIG. 3. The blades 16 are portions of a cylindrical surface 18 as shown in FIG. 4. The forward portion of the edge 32 of each blade 16 lies in a horizontal plane, as shown in FIG. 2, and in the cylindrical surface 18 as shown in FIG. 4. In the preferred embodiment, the central ridge 30 is at an angle of approximately twenty degrees to the plane containing the leading edge 32 of each blade 16. In a preferred embodiment the width of the rear of the fluke is between about seventy and about eighty percent of the length of the fluke.

Figure 5:
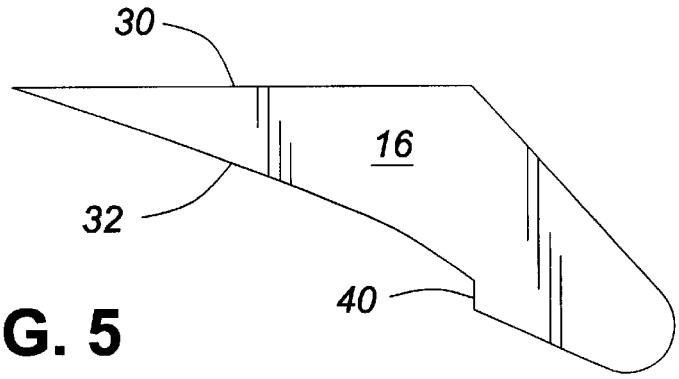
FIG. 5 is a view of the fluke of the anchor in FIG. 1 along the line 2—2 of FIG. 4.

As can best be seen in FIG. 3, each fluke has a fin 40 extending laterally from the aft end of the central ridge 30, with the forward edge perpendicular to the centerline 31 of the anchor 10. In the preferred embodiment, the length of the fin 40 is approximately ten percent of the width of the fluke 12. The fin 40 is an integral part of the blade 16 and is in the cylindrical surface 18 in which the blade 16 lies. FIG. 5 is a projection of the blade 16 and illustrates the complex curve that generates the forward edge 32 and fin 40 of the leading edge of each blade 16.

A ballast weight 50 is attached to the anchor 10 in the space generated, on the underside, between the convex surfaces of blades 16 of the fluke 12 and forward of the junction 23 between the shank 11 and the fluke 12, with no portion projecting below the horizontal plane that contains the forward edge 32 of each blade 16, which is tangential to the convex surfaces of each blade. This is best shown in FIG. 2 and FIG. 4.

It will be appreciated, by those skilled in the art, that the anchor 10 can be made from any conventional anchor material, such as high strength carbon steel, which is preferably rust protected by galvanizing or the like, or stainless steel, which requires no surface rust treatment, but which may be highly polished to provide an aesthetically pleasing appearance. Anchors of this type are usually offered in various sizes and weights, ranging from about 14 pounds up to about 100 pounds or more, for use on boats from about 21 to 120 feet in length. Typically, a 30 pound anchor is suitable for a boat in the 25 to 35 foot range.

I claim:

1. A marine anchor of the type that buries in the seabed when a longitudinal pull is applied, comprising a longitudinal shank having a proximal end connectible to an anchor rode, and a distal end having a double-bladed ploughshare fluke rigidly mounted thereon; and wherein:

d) said shank has a forward edge consisting of a straight section that is tangential to a curved section that terminates at the fluke;

e) said fluke comprises a pair of symmetrically mounted blades, each having partially cylindrical convex and concave surfaces, with a pointed end forward and a divergent rearward section, rigidly connected to each other along a central ridge and symmetrical about a longitudinal medial plane, and wherein the longitudinal axis of each said partial cylindrical surface lies parallel to the central ridge, and the forward edge of the fluke lies on the intersection of the cylindrical surfaces of the blades and a horizontal plane when in an upright position; and f) each said blade of the fluke includes, along an outer edge thereof, a fin in a plane perpendicular to said longitudinal medial plane of the central ridge, spaced laterally from the aft end of the central ridge.

2. An anchor as claimed in claim 1, wherein a ballast weight is attached between the convex surfaces of the blades of the fluke, forward of said mounting between the shank and the fluke, and contained between said convex surfaces and a tangential plane to said convex surfaces.

3. An anchor as claimed in claim 1, wherein the length of each lateral fin is about ten percent of the width of the fluke.

4. An anchor as claimed in claim 1, wherein the central ridge of the fluke is at an angle of about twenty degrees to the plane generated by the forward edge of the fluke.

5. An anchor as claimed in claim 1, wherein the length of the shank is about 1.5 times the length of the fluke.

6. An anchor as claimed in claim 1, wherein the forward edge of the shank is rigidly attached to the fluke adjacent a midpoint of the fluke.

7. An anchor as claimed in claim 1, wherein the width of the rear of the fluke is between about seventy and about eighty percent of the length of the fluke.

* * * * *